US009153908B2

(12) United States Patent
Shimizu et al.

(10) Patent No.: US 9,153,908 B2
(45) **Date of Patent: *Oct. 6, 2015**

(54) LEVER-TYPE CONNECTOR

(75) Inventors: Tomohiko Shimizu, Shizuoka (JP); Akinori Tashiro, Shizuoka (JP); Akihiro Tsuruta, Shizuoka (JP); Kazuya Terao, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 28 days.

This patent is subject to a terminal disclaimer.

(21) Appl. No.: 14/127,513

(22) PCT Filed: Jun. 26, 2012

(86) PCT No.: PCT/JP2012/066250

§ 371 (c)(1),
(2), (4) Date: Dec. 19, 2013

(87) PCT Pub. No.: WO2013/005606

PCT Pub. Date: Jan. 10, 2013

(65) Prior Publication Data

US 2014/0113469 A1 Apr. 24, 2014

(30) Foreign Application Priority Data

Jul. 1, 2011 (JP) ..... 2011-147257

(51) Int. Cl.
*H01R 13/62* (2006.01)
*H01R 13/629* (2006.01)
*H01R 13/74* (2006.01)

(52) U.S. Cl.
CPC ..... *H01R 13/629* (2013.01); *H01R 13/743* (2013.01); *H01R 13/62933* (2013.01)

(58) Field of Classification Search
CPC ..... H01R 13/62938
USPC ..... 439/157
See application file for complete search history.

(56) References Cited

U.S. PATENT DOCUMENTS

2002/0182928 A1* 12/2002 Matsushita ..... 439/489

FOREIGN PATENT DOCUMENTS

JP 2002-359035 A 12/2002
JP 2002-359037 A 12/2002

OTHER PUBLICATIONS

Korean Office action letter issued on Apr. 2, 2015 in the counterpart Korean patent application.

*Primary Examiner* — Abdullah Riyami
*Assistant Examiner* — Thang Nguyen
(74) *Attorney, Agent, or Firm* — Marvin A. Motsenbocker; Mots Law, PLLC

(57) ABSTRACT

A lever-type connector (1) comprises: a first connector (11); a second connector (21); and a lever (31) configured to be turned to fit the connectors (11, 21) each other. The first connector (11) has a lock portion (14) designed to be flexurally deformed toward its inner surface side and inserted into the attachment hole (42) when the connectors are attached to the attachment hole (52). The lever (31) includes an arm portion (32) located on the inner surface side of the first connector (11) while the lever (31) is being turned. The arm portion (32) includes: a deformation blocking part (36) configured to block the flexural deformation when the deformation blocking part (36) is located on the inner surface side of the lock portion (14); and a deformation allowing part (37) configured to allow the flexural deformation.

4 Claims, 7 Drawing Sheets

(a)

(b)

(a)

(b)

LEVER-TYPE CONNECTOR

TECHNICAL FIELD

The present invention relates to a lever-type connector to be attached to a panel.

BACKGROUND ART

A conventional lever-type connector includes: a first connector; a second connector fittable to the first connector; and a lever provided on the first connector and configured to be turned to fit the first connector and the second connector to each other. The first connector and the second connector in a fitted state are attached to an attachment hole in a panel (Japanese Patent Application Publication No. 2002-359037).

This lever-type connector is provided with an interference portion extending from the lever, in order to prevent the connectors in an incompletely fitted state from being attached to the panel. The interference portion does not interfere with a hole edge of the attachment hole when the connectors are in a completely fitted state. The interference portion interferes with the hole edge of the attachment hole when the connectors are in the incompletely fitted state.

Accordingly, in the process of attaching the connectors to the attachment hole in the panel, it is possible to detect a fitted state of the connectors based on whether or not the interference portion interferes with the hole edge of the attachment hole.

CITATION LIST

Patent Literature

[PTL 1] Japanese Patent Application Publication No. 2002-359037

SUMMARY OF INVENTION

Technical Problem

In the above-described lever-type connector, the connectors transition from the incompletely fitted state to the completely fitted state depending on the turning angle of the lever. For this reason, when the tuning angle of the lever is close to the angle corresponding to the completely fitted state of the connectors, the interference by the interference portion with the hole edge of the attachment hole is so small that the connectors may be fitted into the attachment hole even though in the incompletely fitted state. In such a case, it is difficult to detect that the connectors are in the incompletely fitted state.

Here, one conceivable option is to cause the interference portion to extend longer from the lever so as to increase the interference of the interference portion with the hole edge of the attachment hole even in the case where the turning angle of the lever is close to the angle corresponding to the completely fitted state. Nonetheless, this option causes a problem of an increase in the size of the lever-type connector.

In view of the above, it is an object of the present invention to provide a lever-type connector capable of solving the existing challenge to prevent the connectors in an incompletely fitted state from being attached to a panel, and also capable of suppressing an increase in the size of the lever-type connector.

Solution to Problem

For the purpose of achieving the above mentioned object, a lever-type connector of a first aspect of the present invention includes: a first connector; a second connector fittable to the first connector; and a lever provided on any one of the first connector and the second connector, and configured to be turned to fit the first connector and the second connector to each other. The first connector and the second connector in a fitted state are attached to an attachment hole in a panel. The one connector includes a lock portion designed to be flexurally deformed toward its inner surface side and inserted into the attachment hole when the connectors are attached to the attachment hole. The lever includes an arm portion located on the inner surface side of the one connector while the lever is being turned. The arm portion includes: a deformation blocking part configured to block the flexural deformation when the deformation blocking part is located on the inner surface side of the lock portion; and a deformation allowing part configured to allow the flexural deformation when the deformation allowing part is located on the inner surface side of the lock portion. The deformation blocking part is located on the inner surface side of the lock portion when the lever is situated in such a turning position that the first connector and the second connector are in an incompletely fitted state, and the deformation allowing part is located on the inner surface side of the lock portion when the lever is situated in such a turning position that the first connector and the second connector are in a completely fitted state.

In the lever-type connector, the deformation allowing part may be formed from a recessed groove provided in a surface of the arm portion, and the deformation blocking part may formed from the surface of the arm portion excluding the recessed groove.

In the lever-type connector, the lever may further include an operating portion configured to perform a turning operation of the lever, and the lever may be turned by the turning operation of the operating portion.

Advantageous Effects of Invention

According to the lever-type connector of the first aspect of the present invention, when the connectors are in the completely fitted state, the deformation allowing part is located on the inner surface side of the lock portion. Thus, the flexural deformation of the lock portion is allowed and the lever-type connector is attached to the attachment hole in the panel.

On the other hand, when the connectors are in the incompletely fitted state, the deformation blocking part is located on the inner surface side of the lock portion. For this reason, the flexural deformation of the lock portion is blocked and the lever-type connector cannot be attached to the attachment hole in the panel. As a consequence, the connectors in the incompletely fitted state can be prevented from being attached to the panel.

In addition, it is possible to detect a fitted state of the connectors based on whether or not the lever-type connector can be successfully attached to the attachment hole in the panel. For this reason, the lever need not be provided with an interference portion for detecting a fitted state of the connectors, and an increase in size of the lever-type connector can thus be suppressed.

Thus, it is possible to provide the lever-type connector capable of preventing the connectors in the incompletely fitted state from being attached to a panel, and suppressing an increase in the size of the lever-type connector.

When the deformation allowing part is formed from the recessed groove provided in the surface of the arm portion and the deformation blocking part is formed from the surface of the arm portion excluding the recessed groove, the flexural deformation of the lock portion can be blocked or allowed by using the simple structures.

Meanwhile, the lever is turned by the turning operation of the operating portion. Accordingly, it is possible to confirm the establishment of the completely fitted state of the connectors by the turning operation of the lever by hand.

Moreover, the connectors are attached to the panel upon confirmation that the connectors are in the completely fitted state. Thus, it is possible to more reliably prevent the connectors in the incompletely fitted state from being attached to the panel.

DESCRIPTION OF EMBODIMENTS

Figure 1:
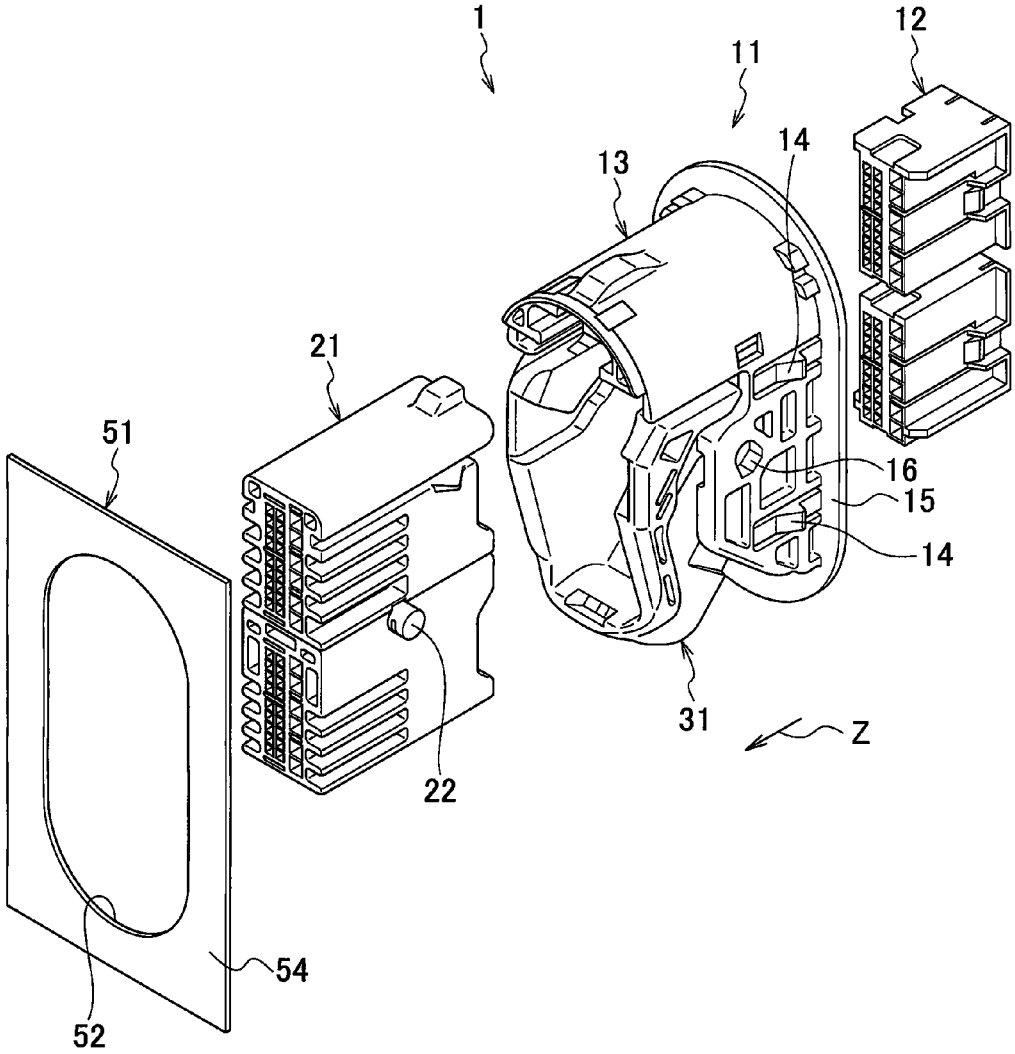
FIG. 1 is an exploded perspective view of a lever-type connector according to an embodiment of the present invention.
Figure 2:
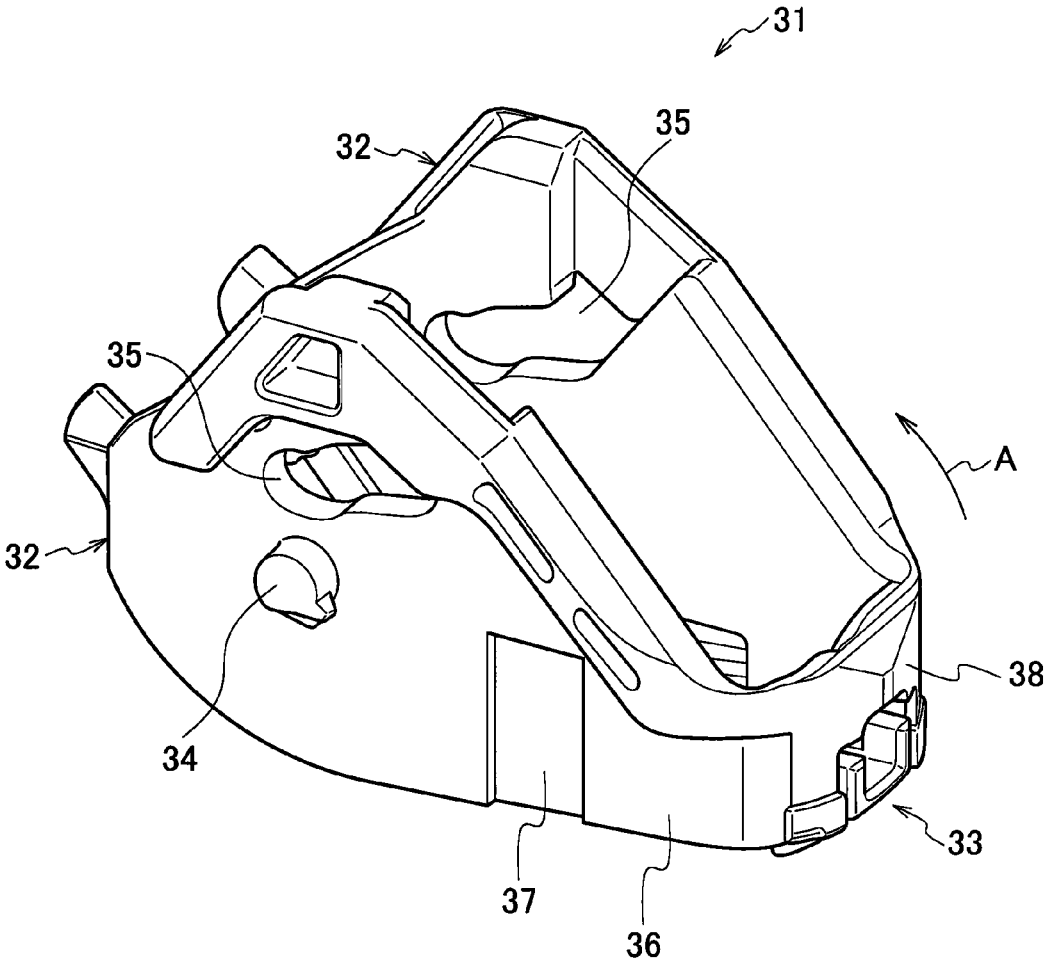
FIG. 2 is a perspective view showing a lever according to the embodiment of the present invention.

An embodiment of the present invention will be described below with reference to the drawings. First, a configuration of a lever-type connector according to the embodiment of the present invention will be described in detail with reference to FIG. 1 and FIG. 2. FIG. 1 is an exploded perspective view of the lever-type connector according to the embodiment of the present invention. FIG. 2 is a perspective view showing a lever according to the embodiment of the present invention.

The lever-type connector according to the embodiment of the present invention relates to an LIF (low insertion force) connector which causes male and female connectors (a first connector and a second connector to be described later), each including multiple terminal tags, to be fitted to each other with a low insertion force.

As shown in FIG. 1, a lever-type connector 1 according to the embodiment of the present invention includes: a first connector 11; a second connector 21 fittable to the first connector 11; and a lever 31 provided on the first connector 11 and configured to be turned to fit the first connector 11 and the second connector 21 to each other.

Further, with the first connector 11 and the second connector 12 fitted to each other, the thus-configured lever-type connector 1 is attached to an attachment hole 52 formed in a panel 51 (see FIG. 6 and FIG. 7 to be described later).

The first connector 11 (the female connector) includes an inner housing 12 configured to house female terminal tags (not shown) provided on a cable terminal, and a frame 13 configured to encase the inner housing 12 inside.

The inner housing 12 has a structure in which two housing components are vertically superposed. The multiple female terminal tags (not shown) are housed inside the inner housing 12. The inner housing 12 is encased in the frame 13.

The frame 13 includes: multiple (four in the embodiment of the present invention) lock portions 14 which are flexurally deformably provided; a flange portion 15 provided on the outer periphery of the frame 13; and a pair of rotating shaft holes 16 (one of which is not shown), into which rotating shaft pins (see FIG. 2) of the lever 31 to be described later are inserted.

Each of the multiple lock portions 14 includes: a lock projecting part 17 which projects to the outside of the first connector 11 (for example, in a direction of an arrow X in FIG. 4(*a*) to be described later); and a lock contact part 18 provided on the inside of the first connector 11 (for example, in a direction of an arrow Y in FIG. 4(*a*) to be described later) and contactable to the lever 31 (see FIG. 5 to be described later).

In addition, when the multiple lock portions 14 configured as described above are attached to the attachment hole 52 in the panel 51, each of the lock portions 14 is inserted into the attachment hole 52 (see FIG. 7 to be described later) while flexurally deformed toward an inner surface side of the first connector 11 (for example, in the direction of the arrow Y in FIG. 4(*a*) to be described later).

Figure 4:
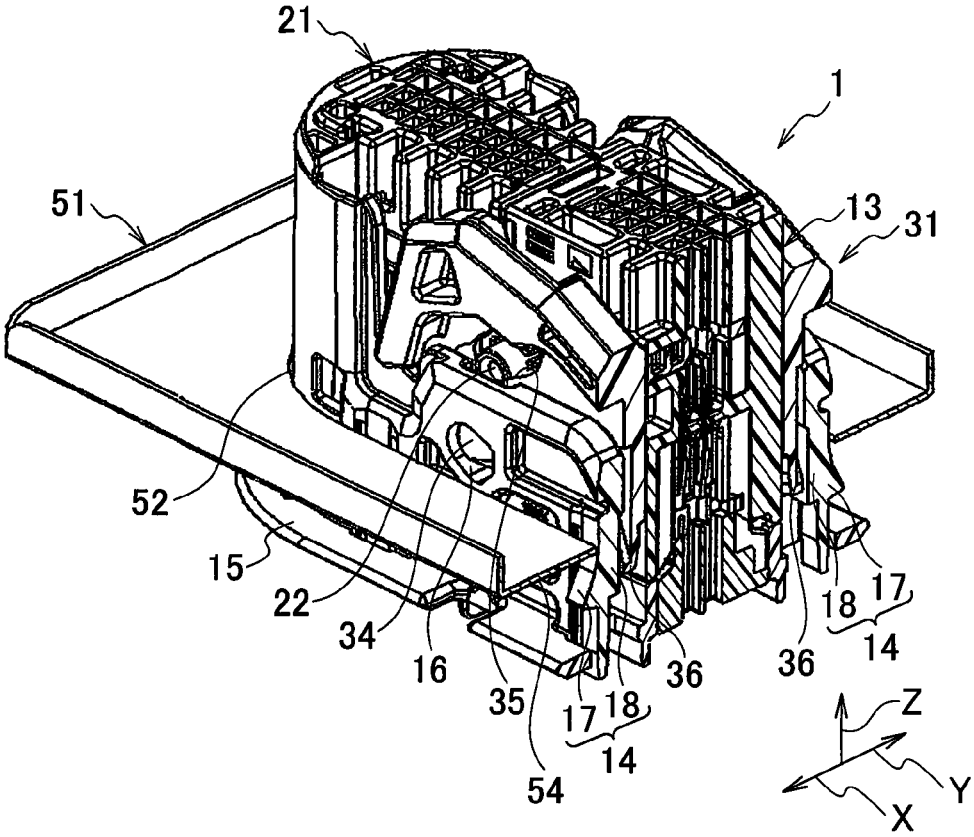
FIG. 4 depicts a cross-sectional view showing relations between lock portions and arm portions when the connectors according to the embodiment of the present invention are in the incompletely fitted state, and a perspective view showing the lever.
Figure 4:
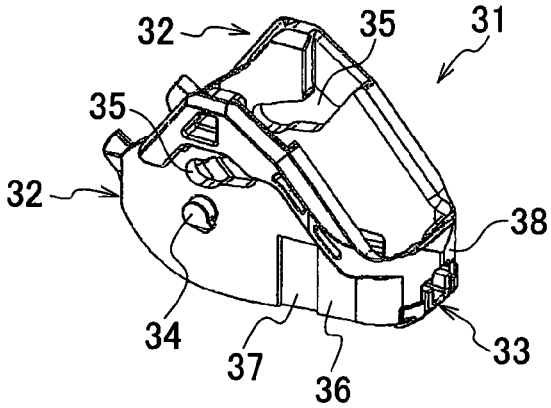

Once the first connector 11 and the second connector 21 in the completely fitted state are pressed toward a front face side of the panel 51 (in a direction indicated with an arrow Z in FIG. 1 and FIG. 4(*a*)), the lock projecting parts 17 come into contact with the panel 51 from its rear face side 54 (see FIG. 1), and thereby fix the connectors 11 and 12 to the panel 51.

The lock contact parts 18 come into contact with deformation blocking parts 36 (see FIG. 2) of the lever 31 to be described later, thereby blocking the flexural deformation of the lock portions 14. In addition, when the lock contact parts 18 come out of contact with the lever 31 with the assistance of deformation allowing parts 37 (see FIG. 2) of the lever 31 to be described later, the lock contact parts 18 allow the flexural deformation of the lock portions 14 (see FIG. 5 and FIG. 8 to be described later).

Once the first connector 11 and the second connector in the fitted state are attached to the attachment hole 52 in the panel 51, the flange portion 15 comes into contact with a hole edge of the attachment hole 52 from the front face side of the panel 51 (in the direction indicated with the arrow Z in each of FIG. 1 and FIG. 4(*a*)).

The pair of rotating shaft pins 34 (see FIG. 2) provided on the lever 31 to be described later are respectively inserted into the pair of rotating shaft holes 16 from the inside of the first connector 11. As a consequence of the insertion of the rotating shaft pins 34 into the rotating shaft holes 16, the lever 31 is rotatably attached to the first connector 11 (the frame 13).

The second connector 21 has a structure in which two housing components larger than those of the inner housing 12 are vertically superposed. The multiple male terminal tags (not shown) are housed inside the second connector 21. When the first connector 11 and the second connector 21 are in the completely fitted state, the male terminal tags are connected to the female terminal tags (not shown) housed inside the inner housing 12.

Meanwhile, cam followers 22 (one of which is not shown) to be inserted into cam grooves 35 (see FIG. 2) of the lever 31 to be described later are respectively provided in a projecting manner on two side surfaces of the second connector 21. By inserting the cam followers 22 into the cam grooves 35 and then turning the lever 31, the second connector 21 is drawn into the first connector 11.

As shown in FIG. 2, the lever 31 includes: a pair of arm portions 32, each of which is located on an inner surface side of the first connector 11 (see FIG. 1) (for example, in the direction of the arrow X in FIG. 4(*a*) to be described later) when the lever 31 is turned; and a connecting portion 33 that connects the pair of arm portions 32.

The pair of arm portions 32 include: the pair of rotating shaft pins 34 (one of which is not shown) to be inserted into the rotating shaft holes 16 of the frame 13 (see FIG. 1); the pair of cam grooves 35 into which the cam followers 22 (see FIG. 1) of the second connector 21 are inserted; the deformation blocking parts 36 which block the flexural deformation of the lock portions 14 of the frame 13; and the deformation allowing parts 37 which allow the flexural deformation of the lock portions 14.

The pair of rotating shaft pins 34 are inserted into the rotating shaft holes 16 (see FIG. 1) from the inside of the first connector. Thus, the lever 31 is rotatably attached to the first connector 11 (the frame 13).

The cam grooves 35 are respectively formed on the pair of arm portions 32. When the lever 31 is turned with the cam followers 22 (see FIG. 1) inserted in the cam grooves 35, the distance between each cam follower 22 and the corresponding rotating shaft pin 34 is changed whereby the second connector 21 moves toward the first connector 11 (see FIG. 1).

The deformation blocking parts 36 are formed from the surfaces of the arm portions 32 excluding the recessed grooves (the deformation allowing parts 37) formed in those surfaces. Each of the deformation blocking parts 36 is located on the inner surface side of the corresponding lock portion 14 (for example, in the direction of the arrow Y in FIG. 4(*a*) to be described later) when the lever 31 is situated in such a turning position that the first connector 11 and the second connector 21 are in the incompletely fitted state. Thus, the deformation blocking parts 36 block the flexural deformation of the lock portions 14 (see FIG. 4(*a*) and FIG. 5 to be described later).

In other words, when each of the deformation blocking parts 36 is located on the inner surface side of the corresponding lock portion 14 (for example, in the direction of the arrow Y in FIG. 4(*a*) to be described later), the deformation blocking part 36 is in contact with the lock contact part 18 of the corresponding lock portion 14 and blocks the flexural deformation of the lock portion 14.

Each of the deformation allowing parts 37 is formed from the recessed groove provided in the surface of the corresponding arm portion 32. Each deformation allowing part 37 is located on the inner surface side of the corresponding lock portion 14 when the lever 31 is situated in such a turning position that the first connector 11 and the second connector 21 are in the completely fitted state. Thus, the deformation allowing parts 37 allow the flexural deformation of the lock portions 14 (see FIG. 7(*a*) and FIG. 8 to be described later).

In other words, when each of the deformation allowing parts 37 is located on the inner surface side of the corresponding lock portion 14 (for example, in the direction of an arrow Y in FIG. 7(*a*) to be described later), the lock contact part 18 of the lock portion 14 is out of contact with the corresponding arm portion 32 of the lever 31. Thus, the deformation allowing parts 37 allow the flexural deformation of the lock portions 14.

As described above, the deformation allowing parts 37 are formed from the recessed grooves provided in the surfaces of the arm portions 32, while the deformation blocking parts 36 are formed from the surfaces of the arm portions 32 excluding the recessed grooves. As a consequence, the flexural deformation of the lock portions 14 can be blocked or allowed by using the simple structures.

When the lever 31 is situated in such a turning position that the first connector 11 and the second connector 21 are in the incompletely fitted state (the position of the lever 31 shown in FIG. 3 to FIG. 5), each of the above-described arm portions 32 is displaced in response to the turn of the lever 31 in such a way as to locate the corresponding deformation blocking part 36 on the inner surface side of the corresponding lock portion 14 (for example, in the direction of the arrow Y in FIG. 4(*a*) to be described later) (see FIG. 4(*a*) and FIG. 4(*b*)).

In the meantime, when the lever 31 is situated in such a turning position that the first connector 11 and the second connector 21 are in the completely fitted state (the position of the lever 31 shown in FIG. 6 to FIG. 8), each of the arm portions 32 is displaced in response to the turn of the lever 31 in such a way as to locate the corresponding deformation allowing part 37 on the inner surface side of the corresponding lock portion 14 (for example, in the direction of the arrow Y in FIG. 4(*a*) to be described later) (see FIG. 7(*a*) and FIG. 7(*b*)).

Hence, the arm portions 32 are provided with the deformation blocking parts 36 and the deformation allowing parts 37 corresponding to the turning angles of the lever 31 in such a way that the deformation blocking parts 36 or the deformation allowing parts 37 are located on the inner surface side of the corresponding lock portions 14 (for example, in the direction of the arrow Y in FIG. 4(*a*) to be described later) depending on the turning position of the lever 31.

The connecting portion 33 includes an operating portion 38 which is subjected to a tuning operation when the lever 31 is turned. When the lever 31 is turned by operating the operating portion 38 in a direction of an arrow A in FIG. 2, the connecting portion 33 is displaced along an arc around the rotating shaft pins 34 (the rotation center).

The lever 31 is turned by the turning operation of the operating portion 38 as described above. Hence, it is possible to confirm the establishment of the completely fitted state of the connectors 11 and 12 by the turning operation of the lever 31 by hand.

In addition, the lever-type connector 1 of the embodiment follows procedures for attaching the lever-type connector 1 to the panel 51 after confirming the establishment of the completely fitted state of the connectors 11 and 12 as will be described later. Thus, it is possible to more reliably prevent the connectors 11 and 12 in the incompletely fitted state from being attached to the panel 51.

Moreover, the above-described first connector 11 and second connector 21 in the fitted state are attached to the panel 51. The panel 51 is provided with: the attachment hole 52 having a vertical ellipsoidal shape and allowing the insertion of the lock portions 14; and the rear surface side 54 to which the projecting parts 17 is contactable (see FIG. 1).

Figure 3:
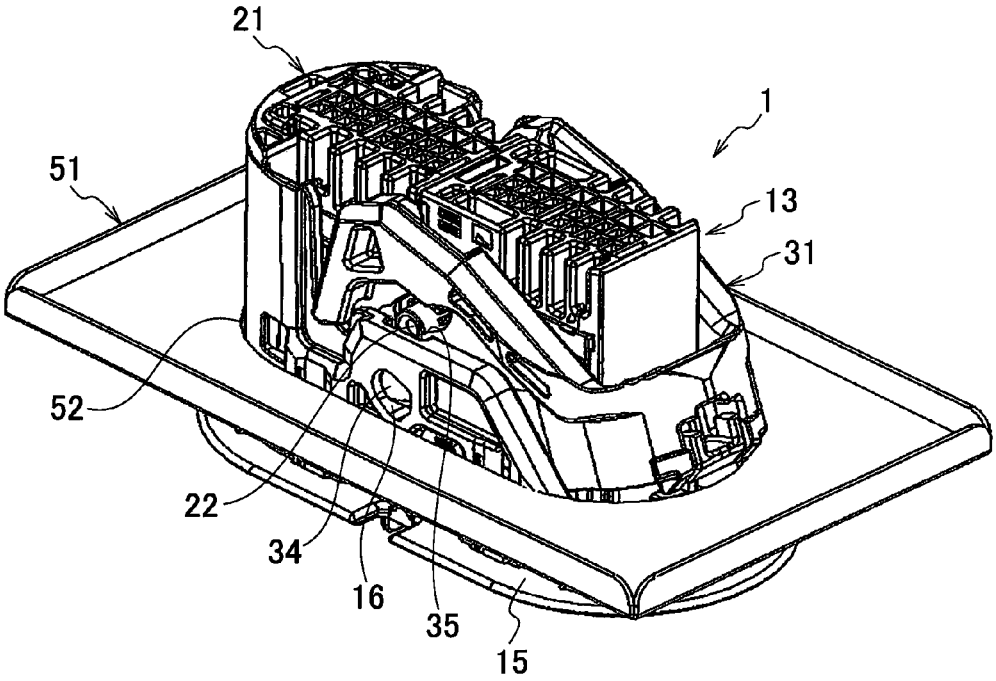
FIG. 3 is a perspective view showing connectors according to the embodiment of the present invention, which are in an incompletely fitted state.

Next, work of fitting the lever-type connector according to the embodiment of the present invention will be described with reference to FIG. 3 to FIG. 8. FIG. 3 is a perspective view showing the connectors according to the embodiment of the present invention, which are in the incompletely fitted state.

Meanwhile, FIG. 4(*a*) is a cross-sectional view showing relations between the lock portions and the arm portions when the connectors according to the embodiment of the present invention are in the incompletely fitted state. FIG. 4(*b*) is a perspective view showing the lever in FIG. 4(*a*). FIG. 5 is a side view showing a position of a deformation blocking part when the connectors according to the embodiment of the present invention are in the incompletely fitted state.

Figure 6:
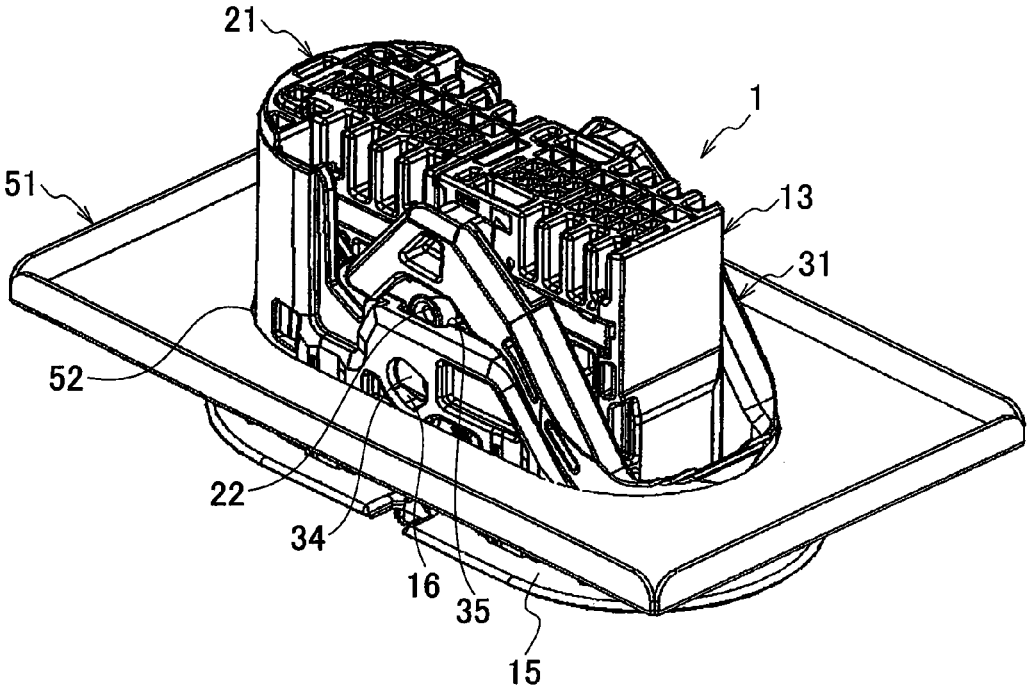
FIG. 6 is a perspective view showing the connectors according to the embodiment of the present invention in a completely fitted state.

Further, FIG. 6 is a perspective view showing the connectors according to the embodiment of the present invention in the completely fitted state. FIG. 7 (*a*) is a cross-sectional view showing relations between the lock projecting parts and the arm portions when the connectors according to the embodiment of the present invention are in the completely fitted state. FIG. 7(*b*) is a perspective view showing the lever in FIG. 7 (*a*). FIG. 8 is a side view showing a position of a deformation allowing part when the connectors according to the embodiment of the present invention are in the completely fitted state.

When the second connector 21 is fitted to the first connector 11, the rotating shaft pins 34 of the lever 31 are first inserted into the rotating shaft holes 16 in the frame 13. Thus, the lever 31 is rotatably attached to the first connector 11 (the frame 13) (see FIG. 3 and FIG. 4(*a*), for example).

After the lever 31 is attached to the first connector 11, the second connector 21 is slightly fitted into the frame 13 while holding the lever 31 at an initial position (such as a position shown in FIG. 1). Thus, the cam followers 22 are inserted into the cam grooves 35.

When the operating portion 38 of the lever 31 is subjected to the turning operation with the cam followers 22 inserted in the cam grooves 35, the distance between each cam follower 22 and the corresponding rotating shaft pin 34 becomes shorter and the second connector 21 is drawn into the first connector 11.

Figure 7:
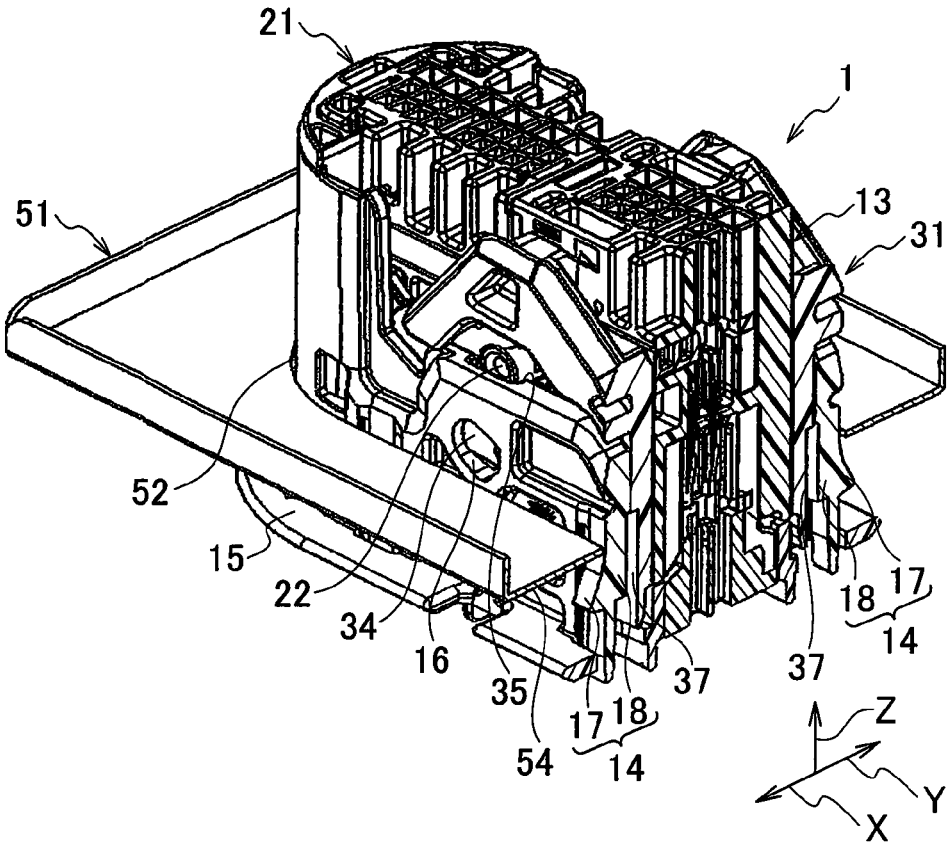
FIG. 7 depicts a cross-sectional view showing relations between the lock projecting parts and the arm portions when the connectors according to the embodiment of the present invention are in the completely fitted state, and a perspective view showing the lever.
Figure 7:
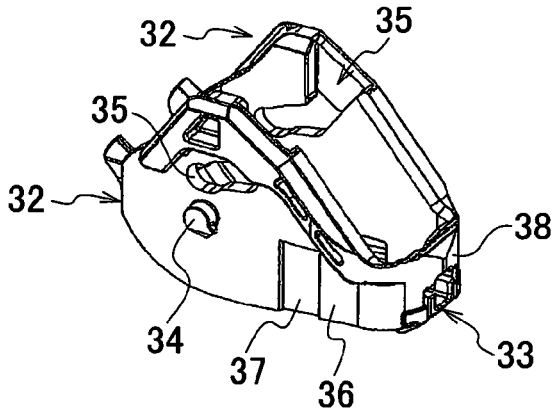
Figure 8:
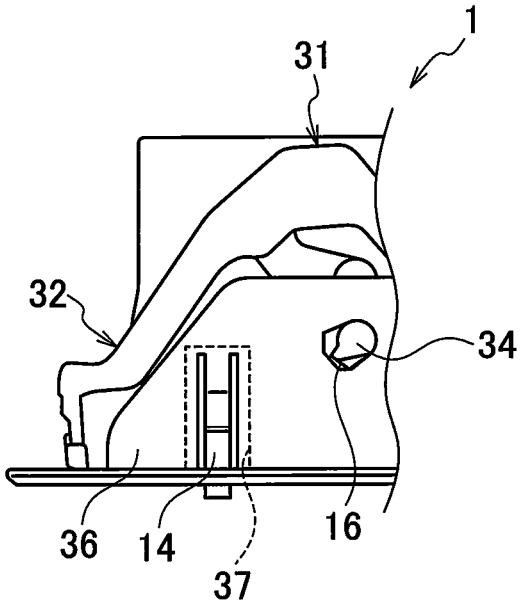
FIG. 8 is a side view showing a position of a deformation allowing part when the connectors according to the embodiment of the present invention are in the completely fitted state.

Then, as the lever 31 turns, the first connector 11 and the second connector 21 transition from the position in the incompletely fitted state (the position of the lever 31 shown in FIG. 3 to FIG. 5) into the completely fitted state (the position of the lever 31 shown in FIG. 6 to FIG. 8). Hence, the female terminal tags (not shown) are connected to the male terminal tags (not shown) to achieve conduction.

When the first connector 11 and the second connector 21 in the completely fitted state as described above are pressed toward the front face side of the panel 51 (in the direction indicated with the arrow Z in FIG. 1 and FIG. 4(*a*)), the first connector 11 and the second connector 21 are attached to the attachment hole 52 formed in the panel 51.

Here, when the lever 31 is situated in such a turning position that the first connector 11 and the second connector 21 are in the incompletely fitted state (the position of the lever 31 shown in FIG. 3 to FIG. 5), each of the deformation blocking parts 36 is located on the inner surface side of the corresponding lock portion 14 (for example, the side in the direction of the arrow Y in FIG. 4 to be described later) as shown in FIG. 4(*a*) and FIG. 4(*b*).

Figure 5:
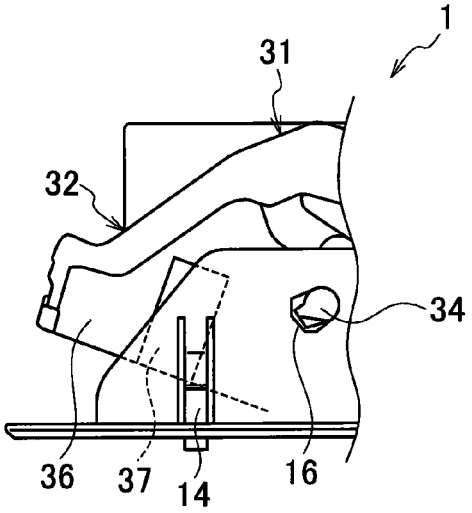
FIG. 5 is a side view showing a position of a deformation blocking part when the connectors according to the embodiment of the present invention are in the incompletely fitted state.

For this reason, as shown in FIG. 4 and FIG. 5, the lock contact parts 18 of the lock portions 14 is in contact with the deformation blocking parts 36. Thus, the deformation blocking parts 36 block the flexural deformation of the lock portions 14.

When the lever 31 is situated in such a turning position (the position of the lever 31 shown in FIG. 3 to FIG. 5) that the first connector 11 and the second connector 21 are in the incompletely fitted state as described above, the flexural deformation of the lock portions 14 are inhibited by the deformation blocking parts 36, and the lock portions 14 cannot be inserted into the attachment hole 52.

As a consequence, if the lock portions 14 cannot be inserted into the attachment hole 52, then it is possible to recognize that the first connector 11 and the second connector 21 are in the incompletely fitted state.

Meanwhile, when the first connector 11 and the second connector 21 are in the incompletely fitted state, the lock portions 14 cannot be inserted into the attachment hole 52. Thus, the connectors 11 and 21 in the incompletely fitted state can be prevented from being attached to the panel 51.

On the other hand, when the lever 31 is situated in such a turning position (the position of the lever 31 shown in FIG. 6 to FIG. 8) that the first connector 11 and the second connector 21 are in the completely fitted state, each of the deformation allowing parts 37 is located on the inner surface side of the corresponding lock portion 14 (for example, the side in the direction of the arrow Y in FIG. 7 (*a*)) as shown in FIG. 7(*a*) and FIG. 7(*b*).

For this reason, as shown in FIG. 7 and FIG. 8, the lock contact parts 18 of the lock portions 14 are out of contact with the arm portions 32 of the lever 31. Thus, the deformation allowing parts 37 allow the flexural deformation of the lock portions 14.

Since the flexural deformation of the lock portions 14 is allowed, when the first connector 11 and the second connector 21 in the completely fitted state are fitted into the attachment hole 52 in the panel 51, each of the lock portions 14 is flexurally deformed toward the inner surface side of the first connector 11 (for example, in the direction of the arrow Y in FIG. 7) by a force to press the connectors 11 and 21 toward the front face side of the panel 51 (in the direction of the arrow Z in FIG. 1 and FIG. 4(*a*)), and is thereby inserted into the attachment hole 52.

After the lock portions 14 are inserted into the attachment hole 52, the flexurally deformed lock portions 14 restores its original form, and the lock projecting parts 17 come into contact with the panel 51 from the rear face side 54. In addition, the flange portion 15 comes into contact with the hole edge (not shown) from the front face side (the side in the arrow Z in each of FIG. 1 and FIG. 4(*a*)) of the panel 51. Hence, the first connector 11 and the second connector 21 are fixed to the panel 51.

Thus, the deformation allowing parts 37 are located on the inner surface side of the lock portions 14 when the connectors 11 and 21 are in the completely fitted state. Accordingly, the flexural deformation of the lock portions 14 is allowed whereby the lever-type connector 1 is attached to the attachment hole 52 in the panel 51.

On the other hand, when the connectors 11 and 12 are in the incompletely fitted state, the deformation blocking parts 36 are located on the inner surface side of the lock portions 14. For this reason, the flexural deformation of the lock portions 14 is blocked and the lever-type connector 1 cannot be attached to the attachment hole 52 in the panel 51. Thus, the connectors 11 and 21 in the incompletely fitted state can be prevented from being attached to the panel 51.

In addition, it is possible to detect a fitted state of connectors 11 and 12 based on whether or not the lever-type connector 1 can be successfully attached to the attachment hole 52 in the panel 51. For this reason, the lever need not be provided with an interference portion for detecting a fitted state of the connectors 11 and 12, and an increase in size of the lever-type connector 1 can thus be suppressed.

As described above, the lever-type connector 1 according to the embodiment of the present invention includes: the first connector 11; the second connector 21 fittable to the first connector; and the lever 31 provided on the connector 11 out of the first connector 11 and the second connector 21, and configured to be turned to fit the first connector 11 and the second connector 21 to each other. The first connector 11 and the second connector 21 in the completely fitted state are attached to the attachment hole 52 in the panel 51. The one connector 11 includes the lock portion 14 which is flexurally deformed toward the inner surface side and inserted into the attachment hole 52 when the connectors are attached to the attachment hole 52. The lever 31 includes the arm portion 32 located on the inner surface side of the one connector 11 when the lever 31 is turned. The arm portion 32 includes: the deformation blocking part 36 which blocks the flexural deformation when the deformation blocking part 36 is located on the inner surface side of the lock portion 14; and the deformation allowing part 37 which allows the flexural deformation when the deformation allowing part 37 is located on the inner surface side of the lock portion 14. The deformation blocking part 36 is located on the inner surface side of the lock portion 14 when the lever 31 is situated in such a turning position that the first connector 11 and the second connector 21 are in the incompletely fitted state. The deformation allowing part 37 is located on the inner surface side of the lock portion 14 when the lever 31 is situated in such a turning position that the first connector 11 and the second connector 21 are in the completely fitted state.

Moreover, in the lever-type connector 1 according to the embodiment of the present invention, the deformation allowing part 37 is formed from the recessed groove provided in the surface of the arm portion 32, while the deformation blocking part 36 is formed from the surface of the arm portion 32 excluding the recessed groove.

In addition, in the lever-type connector 1 according to the embodiment of the present invention, the lever 31 further includes the operating portion 38 configured to perform the turning operation of the lever 31. Here, the lever 31 is turned by the turning operation of the operating portion 38.

Furthermore, according to the lever-type connector 1 of the embodiment of the present invention, when the connectors 11 and 12 are in the completely fitted state, the deformation allowing part 37 is located on the inner surface side of the lock portion 14. As a consequence, the lock portion 14 is allowed for the flexural deformation whereby the lever-type connector 1 is attached to the attachment hole 52 in the panel 51.

On the other hand, when the connectors 11 and 12 are in the incompletely fitted state, the deformation blocking part 36 is located on the inner surface side of the lock portion 14. Accordingly, the lock portion 14 is inhibited from the flexural deformation, and the lever-type connector 1 cannot be attached to the attachment hole 52 in the panel 51. Thus, the connectors 11 and 12 in the incompletely fitted state can be prevented from being attached to the panel 51.

In addition, it is possible to detect a fitted state of connectors 11 and 12 based on whether or not the lever-type connector 1 can be successfully attached to the attachment hole 52 in the panel 51. For this reason, the lever need not be provided with an interference portion for detecting a fitted state of the connectors 11 and 12, and an increase in size of the lever-type connector 1 can thus be suppressed.

Thus, it is possible to provide the lever-type connector 1, which is capable of preventing the connectors 11 and 12 in the incompletely fitted state from being attached to the panel 51, and suppressing an increase in the size of the lever-type connector 1.

Moreover, in the lever-type connector 1 according to the embodiment of the present invention, the deformation allowing part 37 is formed from the recessed groove provided in the surface of the arm portion 32, while the deformation blocking part 36 is formed from the surface of the arm portion 32 excluding the recessed groove. As a consequence, the flexural deformation of the lock portion 14 can be blocked or allowed by using the simple structures.

Furthermore, in the lever-type connector 1 of the embodiment of the present invention, the lever 31 is turned by the turning operation of the operating portion 38. Thus, it is possible to confirm the establishment of the completely fitted state of the connectors 11 and 12 by the turning operation of the lever 31 by hand.

In addition, the connectors 11 and 12 are attached to the panel 51 after confirming the establishment of the completely fitted state of the connectors 11 and 12. Thus, it is possible to more reliably prevent the connectors 11 and 12 in the incompletely fitted state from being attached to the panel 51.

The lever-type connector according to the embodiment of the present invention has been described above on the basis of the illustrated embodiment. It is to be noted, however, that the present invention is not limited only to the above-described embodiment. The configurations of the components therein may be replaced with other arbitrary configurations having similar functions thereto.

For example, the foregoing descriptions have been provided for the embodiment in which the lock portions 14 are provided at the four positions on the frame 13. However, the number of the lock portions 14 can be changed as appropriate.

In such a case, at least one of the lock portions 14 is to be disposed in such a position to locate the deformation blocking part 36 on the inner surface side of the lock portion 14 when the connectors 11 and 12 are in the incompletely fitted state and to locate the deformation allowing part 37 on the inner surface side when the connectors 11 and 12 are in the completely fitted mode. Thereby, it is possible to obtain the same operation and effects as those of the lever-type connector according to the above-described embodiment of the present invention.

INDUSTRIAL APPLICABILITY

The present invention is extremely useful to prevent incompletely fitted connectors in a lever-type connector from being attached to a panel, and to suppress an increase in the size of the lever-type connector.

The invention claimed is:

1. A lever-type connector comprising:

a first connector;

a second connector fittable to the first connector; and a lever provided on any one of the first connector and the second connector, and configured to be turned to fit the first connector and the second connector to each other, wherein the first connector and the second connector in a fitted state are attached to an attachment hole in a panel, the one connector includes a lock portion designed to be flexurally deformed toward its inner surface side and inserted into the attachment hole when the connectors are attached to the attachment hole, the lever includes an arm portion located on the inner surface side of the one connector while the lever is being turned, the arm portion includes:

a deformation blocking part configured to block the flexural deformation when the deformation blocking part is located on the inner surface side of the lock portion; and a deformation allowing part configured to allow the flexural deformation when the deformation allowing part is located on the inner surface side of the lock portion, and the deformation blocking part is located on the inner surface side of the lock portion when the lever is situated in such a turning position that the first connector and the second connector are in an incompletely fitted state, and the deformation allowing part is located on the inner surface side of the lock portion when the lever is situated in such a turning position that the first connector and the second connector are in a completely fitted state.

2. The lever-type connector according to claim 1, wherein the deformation allowing part is formed from a recessed groove provided in a surface of the arm portion, and the deformation blocking part is formed from the surface of the arm portion excluding the recessed groove.

3. The lever-type connector according to claim 1, wherein the lever further comprises an operating portion configured to perform a turning operation of the lever, and the lever is turned by the turning operation of the operating portion.

4. The lever-type connector according to claim 2, wherein the lever further comprises an operating portion configured to perform a turning operation of the lever, and the lever is turned by the turning operation of the operating portion.

* * * * *